US009951986B1

(12) United States Patent
Turner

(10) Patent No.: US 9,951,986 B1
(45) Date of Patent: Apr. 24, 2018

(54) COOLER WITH INTEGRATING ICE-MAKER

(71) Applicant: Jonathan Turner, Turtlecreek, PA (US)

(72) Inventor: Jonathan Turner, Turtlecreek, PA (US)

( * ) Notice: Subject to any disclaimer, the term of this patent is extended or adjusted under 35 U.S.C. 154(b) by 214 days.

(21) Appl. No.: 14/937,204

(22) Filed: Nov. 10, 2015

(51) Int. Cl.
*F25C 1/22* (2006.01)
*F25C 1/04* (2018.01)
*F25D 3/08* (2006.01)

(52) U.S. Cl.
CPC . *F25C 1/04* (2013.01); *F25D 3/08* (2013.01)

(58) Field of Classification Search
CPC ..... F25D 3/08; F25D 2331/805
USPC ..... 62/340, 344, 371, 457.1, 457.5
See application file for complete search history.

(56) References Cited

U.S. PATENT DOCUMENTS 2,572,508 A 10/1951 Muffly
3,131,551 A 5/1964 Ross
D354,292 S 1/1995 Monti
5,921,103 A 7/1999 Hilsinger
6,401,461 B1 6/2002 Harrison
6,675,602 B2 1/2004 Goodman
7,861,552 B1 * 1/2011 Hughes ..... A45C 11/20 62/371
7,937,964 B2 * 5/2011 Temple ..... H04B 1/08 381/300
8,307,664 B2 11/2012 Whillock, Sr.

FOREIGN PATENT DOCUMENTS

JP H05240541 A 11/2002

* cited by examiner

*Primary Examiner* — Melvin Jones
(74) *Attorney, Agent, or Firm* — Kyle A. Fletcher, Esq.

(57) ABSTRACT

The cooler with integrated ice-maker is a combination cooler and icemaker that takes the accumulated water created in a cooler from melting ice and recycles the accumulated water back into ice. The cooler with integrated ice-maker comprises a cooler, a removable drip shelf, a pump system, and an icemaker.

17 Claims, 6 Drawing Sheets

COOLER WITH INTEGRATING ICE-MAKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of refrigeration and ice making, more specifically, an icemaker configured for use with recycled water.

SUMMARY OF INVENTION

The cooler with integrated ice-maker is a combination cooler and icemaker that takes the accumulated water created in a cooler from melting ice and recycles the accumulated water back into ice.

These together with additional objects, features and advantages of the cooler with integrated ice-maker will be readily apparent to those of ordinary skill in the art upon reading the following detailed description of the presently preferred, but nonetheless illustrative, embodiments when taken in conjunction with the accompanying drawings.

In this respect, before explaining the current embodiments of the cooler with integrated ice-maker in detail, it is to be understood that the cooler with integrated ice-maker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cooler with integrated ice-maker.

It is therefore important that the claims be regarded as including such equivalent construction insofar as they do not depart from the spirit and scope of the cooler with integrated ice-maker. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
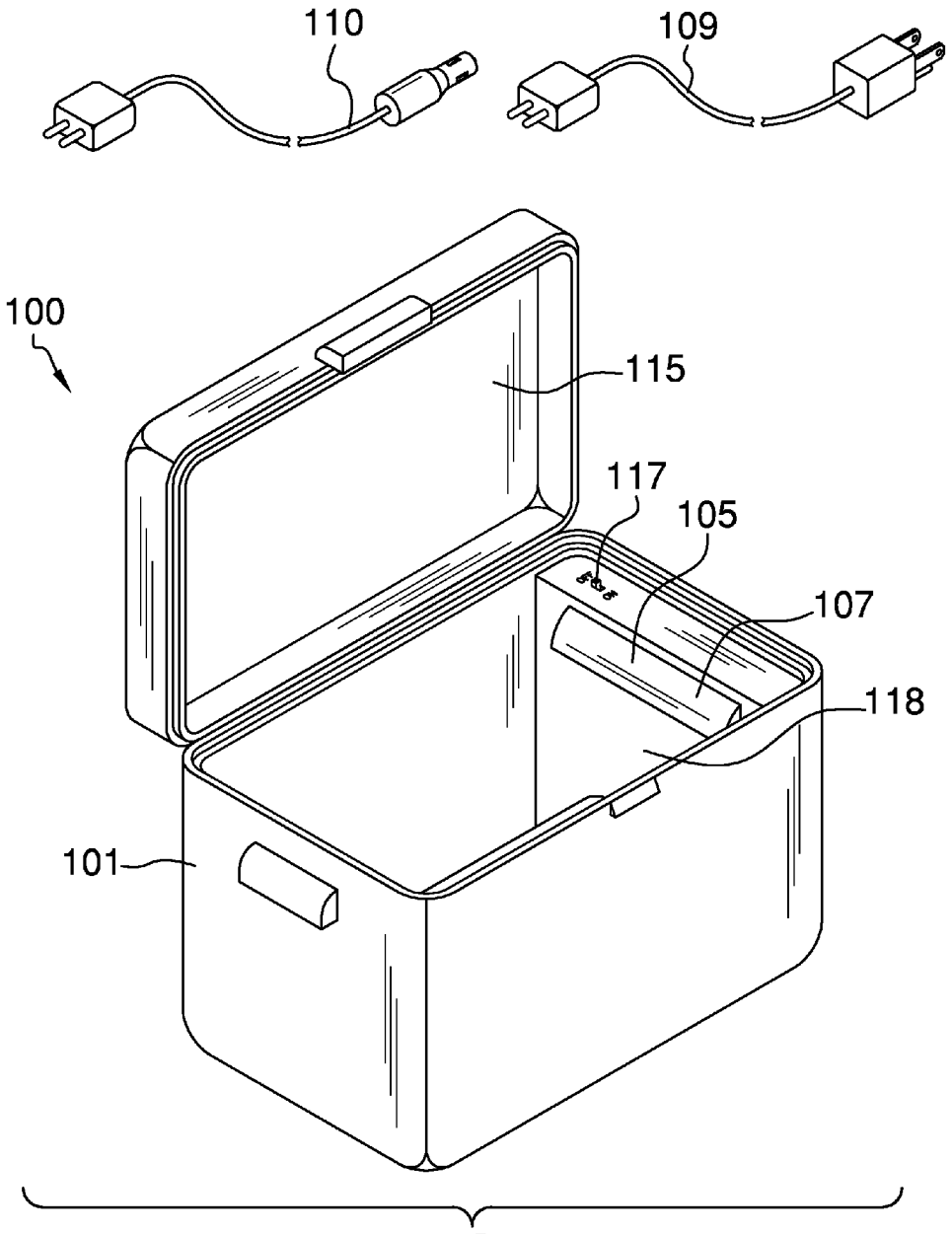
FIG. 1 is a perspective view of an embodiment of the disclosure.
Figure 2:
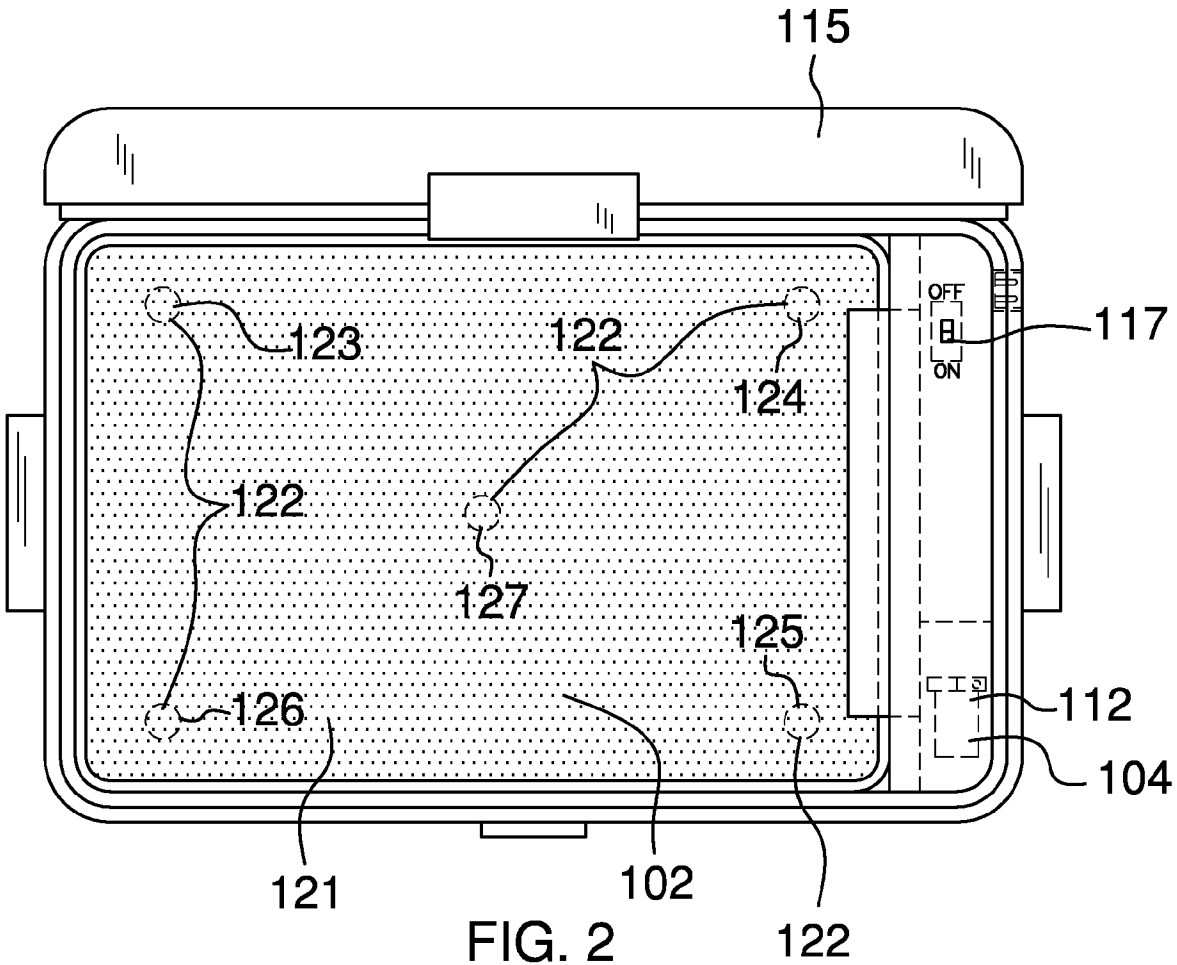
FIG. 2 is a top view of an embodiment of the disclosure.
Figure 3:
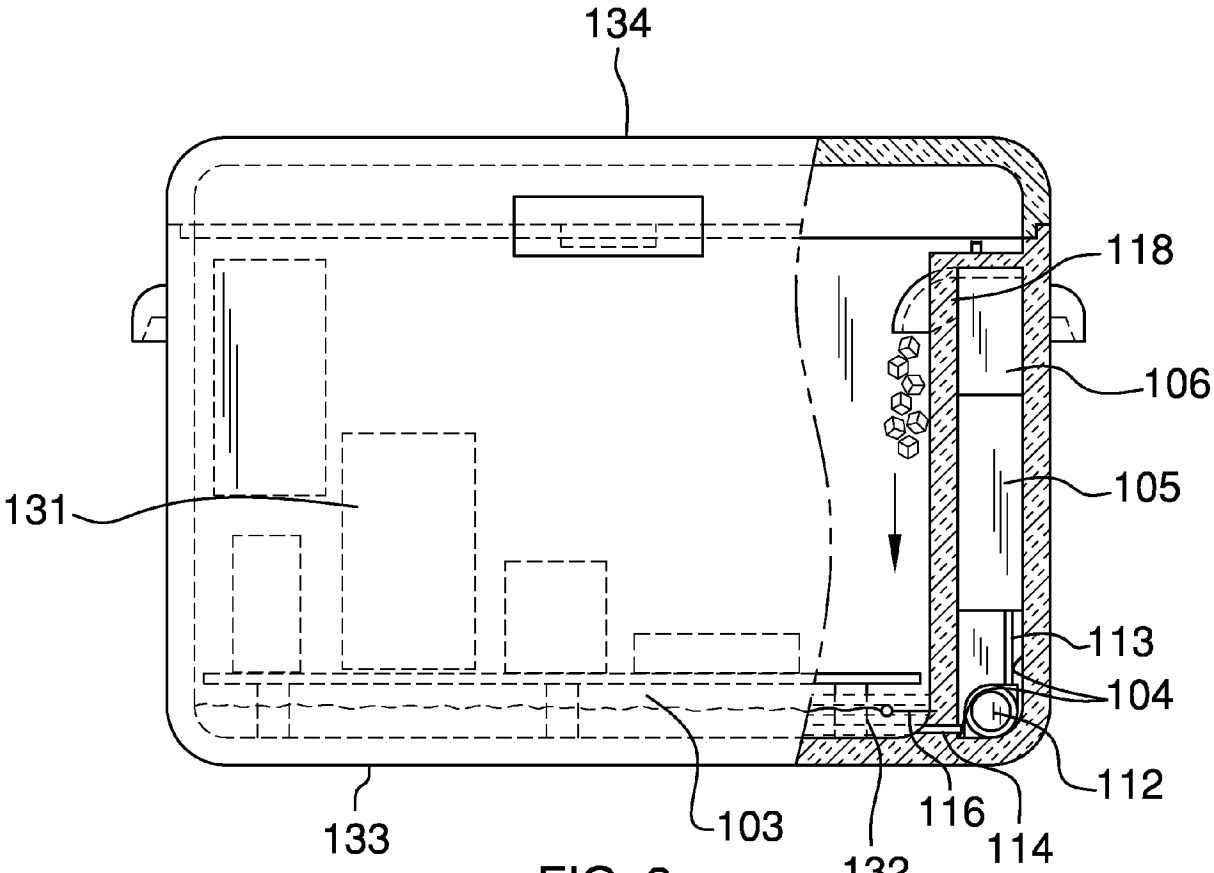
FIG. 3 is a front view of an embodiment of the disclosure.
Figure 4:
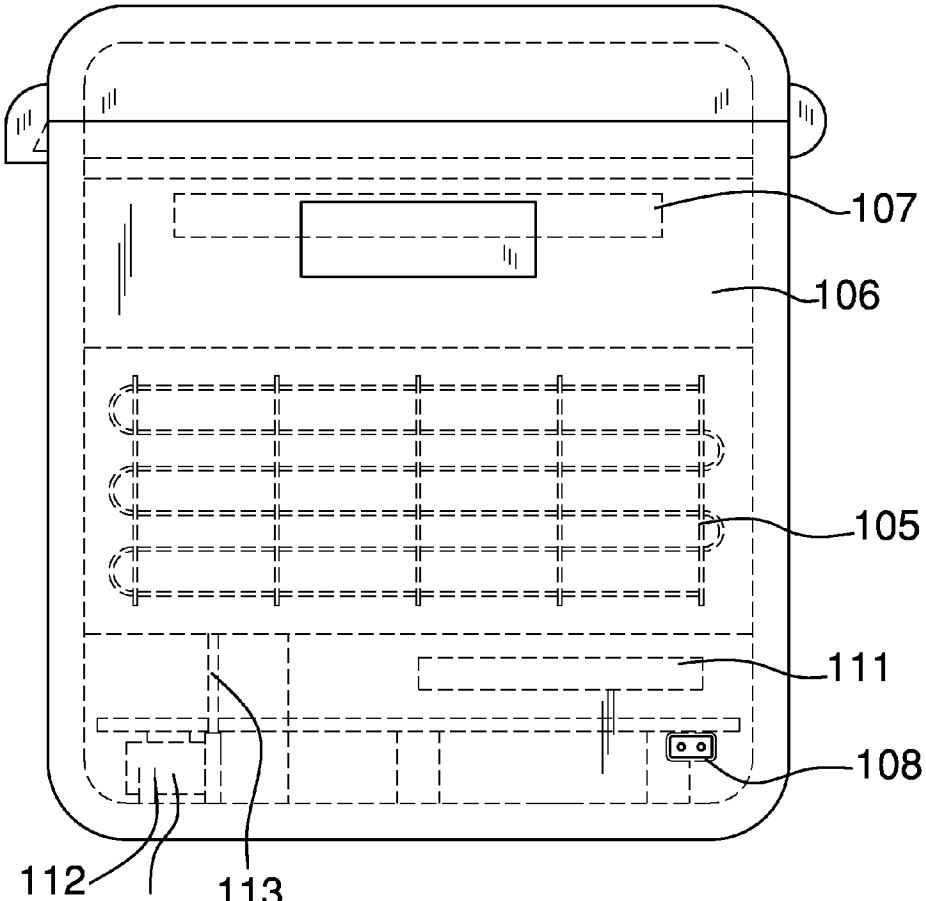
FIG. 4 is a side view of an embodiment of the disclosure.
Figure 5:
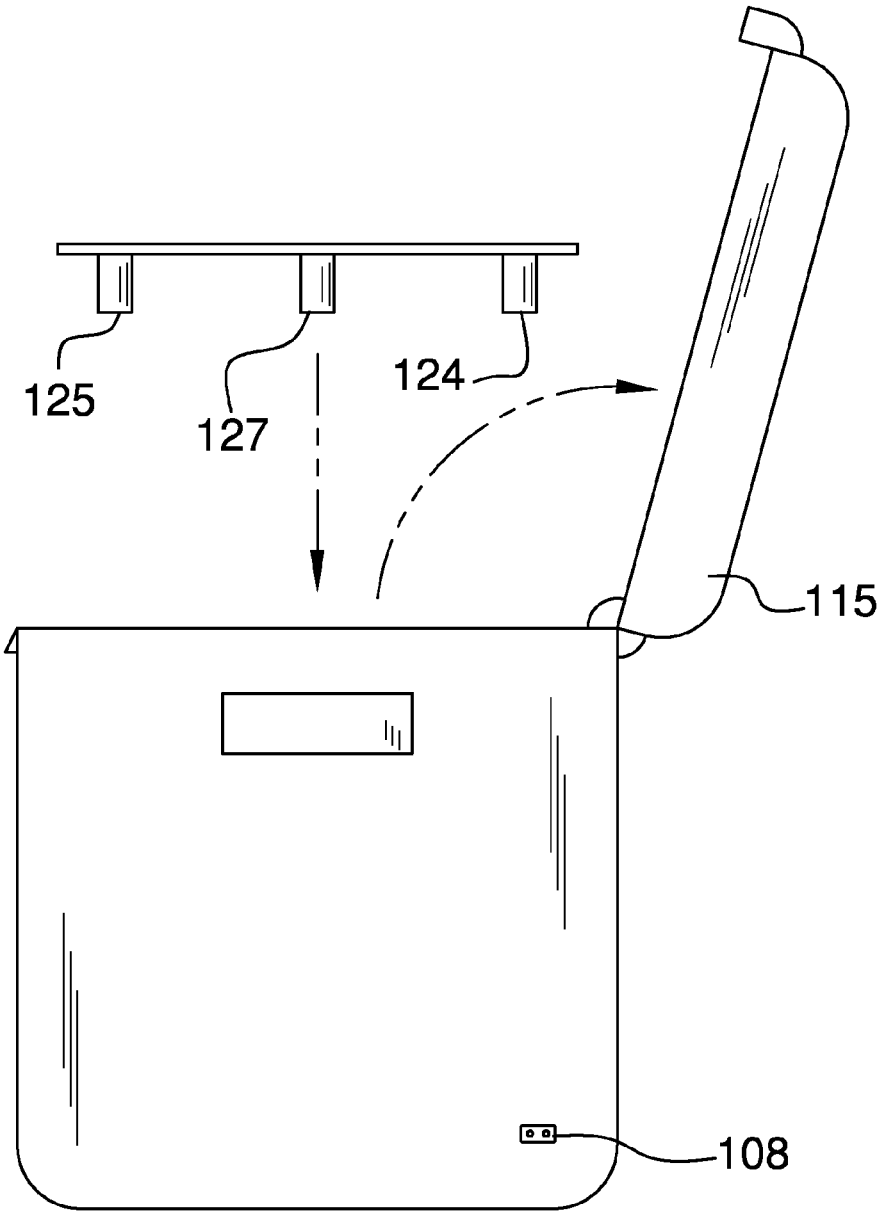
FIG. 5 is an exploded view of an embodiment of the disclosure.
Figure 6:
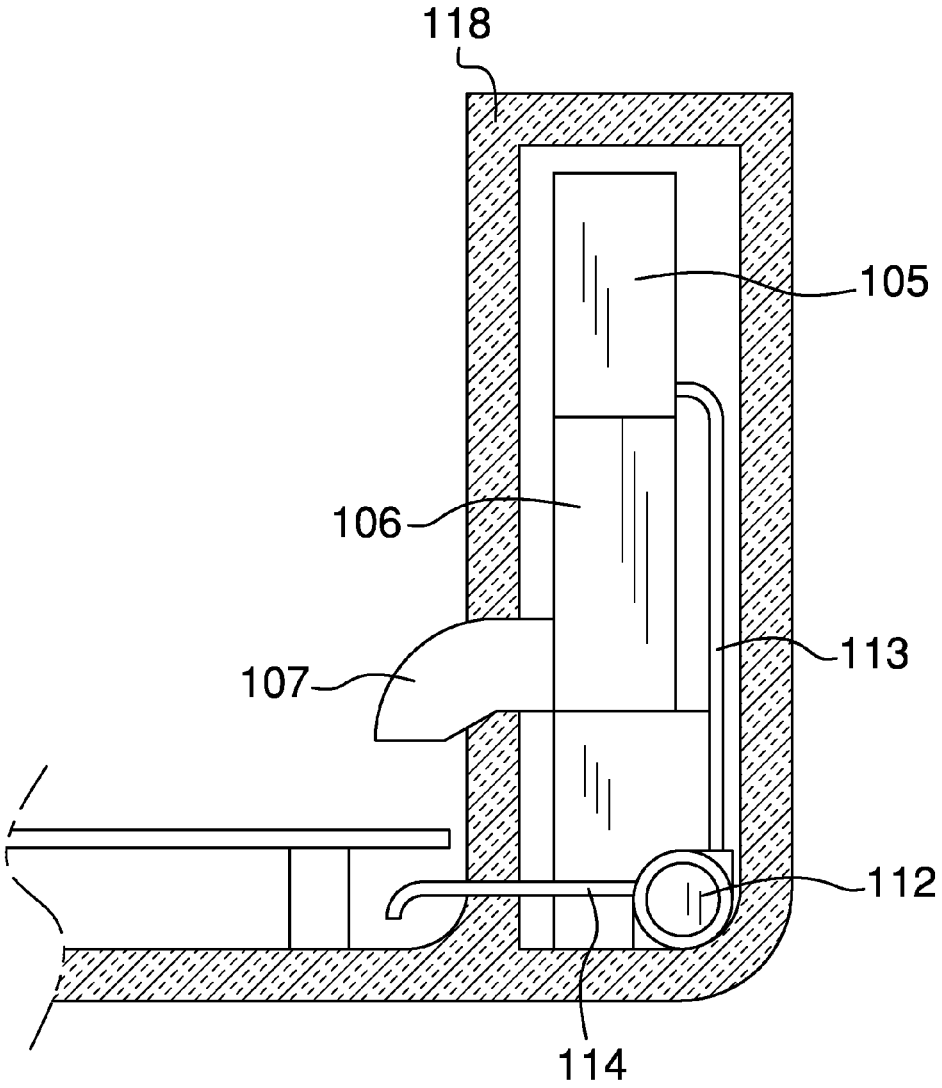
FIG. 6 is a detail view of an embodiment of the disclosure.

Detailed reference will now be made to a first potential embodiment of the disclosure, which is illustrated in FIGS. 1 through 6. The cooler with integrated ice-maker 100 (hereinafter invention) comprises a cooler 101, a removable drip shelf 102, a pump system 104, and an icemaker 105.

The cooler 101 is an insulated container that is intended to keep the contents 131 of the cooler 101 cold. The removable drip shelf 102 is a shelf that is intended to raise the contents 131 of the cooler 101 off the bottom 133 of the container. The removable drip shelf 102 comprises a plate 121 and a plurality of legs 122. The purpose of the plate 121 is to provide a surface, other than the bottom 133 of the container, upon which the contents 131 of the cooler 101 and the ice used to cool the contents 131 of the cooler 101 can rest. The purpose of the plurality of legs 122 is to raise the plate 121 above the bottom 133 of the container creating a reservoir area 103. The purpose of the removable drip shelf 102 is to allow the melting water 132 to accumulate in the reservoir area 103 clear of the contents 131 of the cooler 101 and the ice itself. The removable drip shelf 102 can be removed from the cooler 101 for cleaning purposes or when more storage space is desired within the cooler 101.

In the first potential embodiment of the disclosure, the plurality of legs 122 further comprises a first individual leg 123, a second individual leg 124, a third individual leg 125, a fourth individual leg 126, and a fifth individual leg 127. The first individual leg 123 is attached to the to the bottom 133 side of the plate 121 in the proximity of a first corner of the four corners of the plate 121. The second individual leg 124 is attached to the to the bottom 133 side of the plate 121 in the proximity of a second corner of the four corners of the plate 121. The third individual leg 125 is attached to the to the bottom 133 side of the plate 121 in the proximity of a third corner of the four corners of the plate 121. The fourth individual leg 126 is attached to the to the bottom 133 side of the plate 121 in the proximity of a fourth corner of the four corners of the plate 121. The fifth individual leg 127 is attached to the bottom 133 side of the plate 121 at the center of the plate 121.

The purpose of the pump system 104 is to pump the accumulated water 132 from the reservoir area 103 into the icemaker 105. The pump system 104 is mounted on the wall of the cooler 101 near the bottom 133 of the cooler 101. The pump system 104 further comprises a water pump 112, a water line 113, and a water inlet 114. The water pump 112 is an electrically powered pump that pumps accumulated water 132 from the reservoir area 103 into the icemaker 105 for refreezing. The water pump 112 draws the accumulated water 132 from the reservoir area 103 into the water pump 112 through a tube called the water inlet 114. The water pump 112 delivers the accumulated water 132 into the icemaker 105 through a tube called the water line 113. The water pump 112 moves water from the water inlet 114 into the intake of the water pump 112 and transports the accumulated water 132 from the output of the water pump 112 through the water line 113 into the water intake of the icemaker 105. The operation of the water pump 112 is controlled through the use of level controllers positioned in the reservoir area 103 and the icemaker 105. If the accumulated water 132 level in the reservoir area 103, as measured through a reservoir area 103 level controller 116, is too low then the water pump 112 is disabled. Similarly, if the water container within the icemaker 105 is too full to receive additional water, the water pump 112 is disabled. This means that accumulated water 132 is only pumped from the reservoir area 103 to the icemaker 105 when the icemaker 105 is in a position to receive the accumulated water 132 and when the reservoir area 103 contains an adequate amount of accumulated water 132 to supply the water pump 112. The use of level controllers to control the operation of a pump is well known and documented in the art.

The purpose of the icemaker 105 is to refreeze the accumulated water 132 delivered to it by the water pump 112 into ice cubes and to return these ice cubes to the cooler 101. The icemaker 105 is modified from a commercially available portable icemaker and is mounted to the side of the cooler 101 between the pump system 104 and the top 134 of the cooler 101. After the icemaker 105 has frozen the accumulated water 132 into ice cubes, it deposits the ice cubes into an ice compartment 106. The ice compartment 106 is mounted on top 134 of the icemaker 105. An ice chute 107 is mounted on top 134 of the ice compartment 106. The ice compartment 106 stores the ice cubes until enough ice cubes have collected that the ice cubes fall out of the ice compartment 106, through the ice chute 107 and back into the cooler 101.

In a second potential embodiment of the disclosure, instead locating the ice compartment 106 above the icemaker 105, the ice compartment 106 is mounted below the icemaker 105 and the ice chute 107 is mounted below the ice compartment 106. In this scenario, the ice cubes fall out of the icemaker 105 directly through the ice compartment 106 and through the ice chute 107. If there are sufficient ice cubes in the cooler 101, the ice cubes in the cooler 101 prevent the newly frozen ice cubes from the icemaker 105 from falling directly into the cooler 101. In this instance, the ice cubes are stored in the ice compartment 106 until the ice cube level falls to a point where the newly frozen ice cubes are drawn from the ice compartment 106 through the ice chute 107 into the cooler 101.

The pump system 104 and the icemaker 105 are powered by an external source of electricity distributed through the invention 100 using a power connection 108. In the third potential embodiment of the disclosure, the power connection 108 is powered from a 120/240 VAC electrical source that is delivered through a 120V cable 109. In a fourth potential embodiment of the disclosure, the power connection 108 is powered by a 12 VDC electrical source that is delivered through a 12 VDC cable 110. In a fifth potential embodiment of the disclosure, a rechargeable battery 111 is provisioned to allow for temporary operation of the invention 100 when electricity is not available.

The overall operation of the invention 100 is controlled using an on off switch 117.

The icemaker 105 and the water pump 112 are positioned behind an insulated water wall 118. The purpose of the water wall 118 is to insulate the contents 131 of the cooler 101 from heat generated by the icemaker 105 and the water pump 112 and to prevent the icemaker 105 and the water pump 112 from getting unnecessarily wet.

To use the invention 100, contents 131 are loaded into the invention 100 along with an initial load of ice cubes. The on off switch is then turned on. The system will automatically operate refreezing the accumulated water 132 back into ice cubes until the on off switch is turned off.

In the first potential embodiment of the disclosure, the cooler 101, icemaker 105, water pump 112, water line 113 and water inlet 114 are commercially available. The removable drip shelf 102, ice chute 107, and ice compartment 106 are formed from molded plastic. Suitable plastics include, but are not limited to, polycarbonate. Methods to install the power connection 108 and distribute electrical power from the power connection 108 to the icemaker 105 and the water pump 112 are well known and documented in the art. The icemaker 105 will have to be modified by disassembling the components (cooling, ice making, ice storage and water delivery) of the icemaker 105 and rearranging them to fit into the space available. Depending on the design, a hole may need to be formed into the cooler 101 to allow for the placement of a cooling fan.

The following definitions and directional references were used in this disclosure:

Center: As used in this disclosure, a center is a point that is: 1) the point within a circle that is equidistant from all the points of the circumference; 2) the point within a regular polygon that is equidistant from all the vertices of the regular polygon; or, 3) the point, pivot, or axis around which something revolves.

Pump: As used in this disclosure, a pump is a mechanical device that uses suction or pressure to raise or move liquids, compress gasses, or force a gas into an inflatable object.

Tube: As used in this disclosure, a tube is a hollow cylindrical device with a first open end and a second open end that is used for transporting liquids and gasses.

Directional References: The lid 115 of the cooler 101 is positioned at the top 134. The side distal from the top 134 of the cooler 101 is the bottom 133 of the cooler 101.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cooler with integrated ice-maker comprising:

a cooler, a removable drip shelf, a pump system, and an icemaker;

wherein the icemaker is an integral part of the cooler;

wherein the icemaker make ice by refreezing a water accumulated at the bottom of the cooler from melted ice;

wherein the icemaker returns this refrozen water to a storage section of the cooler;

wherein the cooler is an insulated container;

wherein the removable drip shelf is a shelf that raises the contents of the cooler off the bottom of the insulated container;

wherein the removable drip shelf further comprises a plate and a plurality of legs.

2. The enhanced cooler according to claim 1 wherein the plurality of legs raises the plate above the bottom of the container.

3. The enhanced cooler according to claim 2 wherein the removable drip shelf creates a reservoir area where the water from the melting ice accumulates.

4. The enhanced cooler according to claim 3 wherein the removable drip shelf can be removed from the cooler.

5. The enhanced cooler according to claim 4 wherein the plurality of legs further comprises a first individual leg, a second individual leg, a third individual leg, a fourth individual leg, and a fifth individual leg.

6. The enhanced cooler according to claim 5 wherein the pump system further comprises a water pump, a water line, and a water inlet.

7. The enhanced cooler according to claim 6 wherein the water pump is an electrically powered pump.

8. The enhanced cooler according to claim 7 wherein the water pump draws the accumulated water from the reservoir area into the water pump through the water inlet.

9. The enhanced cooler according to claim 8 wherein the water pump delivers the accumulated water into the icemaker through the water line.

10. The enhanced cooler according to claim 9 wherein the operation of the water pump is controlled by one or more level controllers.

11. The enhanced cooler according to claim 10 wherein the pump system is mounted on the wall of the cooler in the area of the bottom of the cooler.

12. The enhanced cooler according to claim 11 wherein the icemaker refreezes the accumulated water into ice cubes.

13. The enhanced cooler according to claim 12 wherein the icemaker deposits the refrozen ice cubes into an ice compartment.

14. The enhanced cooler according to claim 13 wherein the ice compartment feeds the ice cubes into the cooler through the ice chute.

15. The enhanced cooler according to claim 14 wherein the ice compartment is mounted on top of the icemaker.

16. The enhanced cooler according to claim 14 wherein the ice compartment is mounted below the icemaker.

17. The enhanced cooler according to claim 14 wherein the icemaker and the pump system are positioned behind an insulated water wall.

* * * * *